US011135848B2

(12) United States Patent
Wong et al.

(10) Patent No.: US 11,135,848 B2
(45) Date of Patent: Oct. 5, 2021

(54) LIQUID EJECTING HEAD AND LIQUID EJECTING APPARATUS

(71) Applicant: TOSHIBA TEC KABUSHIKI KAISHA, Tokyo (JP)

(72) Inventors: Mengfei Wong, Mishima Shizuoka (JP); Ryutaro Kusunoki, Mishima Shizuoka (JP); Shuhei Yokoyama, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/702,351

(22) Filed: Dec. 3, 2019

(65) Prior Publication Data

US 2020/0230957 A1 Jul. 23, 2020

(30) Foreign Application Priority Data

Jan. 22, 2019 (JP) ..... JP2019-008498

(51) Int. Cl.
*B41J 2/045* (2006.01)
*B41J 2/16* (2006.01)
*B41J 2/14* (2006.01)

(52) U.S. Cl.
CPC ..... *B41J 2/1612* (2013.01); *B41J 2/04581* (2013.01); *B41J 2/14233* (2013.01); *B41J 2/161* (2013.01); *B41J 2/162* (2013.01); *B41J 2/164* (2013.01); *B41J 2/1606* (2013.01); *B41J 2/1617* (2013.01); *B41J 2/1626* (2013.01); *B41J 2002/14258* (2013.01);
(Continued)

(58) Field of Classification Search
CPC ..... B41J 2/14233; B41J 2002/14258; B41J 2/04581; B41J 2/1606; B41J 2/161; B41J 2/1612; B41J 2/1617; B41J 2/164; B41J 2002/14491; B41J 2202/22
See application file for complete search history.

(56) References Cited

U.S. PATENT DOCUMENTS

2013/0208055 A1* 8/2013 Hoshino ..... B41J 2/1623 347/71
2013/0222481 A1 8/2013 Yokoyama et al.
(Continued)

FOREIGN PATENT DOCUMENTS

JP 2006159831 A 6/2006

OTHER PUBLICATIONS

Extended European Search Report dated Jun. 5, 2020 in corresponding European Patent Application No. 20152598.7, 7 pages.

*Primary Examiner* — Matthew Luu
*Assistant Examiner* — Kendrick X Liu
(74) *Attorney, Agent, or Firm* — Kim & Stewart LLP

(57) ABSTRACT

A liquid ejecting head includes a driving substrate including a driving element configured to, in response to a signal from an external controller, expand or contract so that a liquid is discharged from a pressure chamber through a nozzle, and a connection portion connecting the driving element to a wiring substrate connectable to the external controller; a sealing member that covers the connection portion and a part of the wiring substrate; and a mask plate partially covering a part of the driving substrate including the connection portion and contacting the sealing member.

20 Claims, 7 Drawing Sheets

(52) U.S. Cl.
CPC .. *B41J 2002/14491* (2013.01); *B41J 2202/20* (2013.01); *B41J 2202/22* (2013.01)

(56) References Cited

U.S. PATENT DOCUMENTS

| | | | | |
|---|---|---|---|---|
| 2013/0222484 | A1* | 8/2013 | Yokoyama | B41J 2/1628 347/70 |
| 2013/0271530 | A1 | 10/2013 | Yokoyama et al. | |
| 2015/0002587 | A1* | 1/2015 | Yokoyama | B41J 2/14201 347/70 |
| 2015/0217569 | A1 | 8/2015 | Otaka et al. | |

* cited by examiner

LIQUID EJECTING HEAD AND LIQUID EJECTING APPARATUS

CROSS-REFERENCE TO RELATED APPLICATIONS

This application is based upon and claims the benefit of priority from Japanese Patent Application No. 2019-008498, filed on Jan. 22, 2019, the entire contents of which are incorporated herein by reference.

FIELD

Embodiments of the present invention relate to a liquid ejecting head and a liquid ejecting apparatus for ejecting liquid from a nozzle.

BACKGROUND

A liquid ejecting apparatus such as an inkjet apparatus is known in which ink droplets are ejected from a nozzle according to an image signal so that an image is formed on a recording sheet by the ink droplets. An inkjet apparatus includes an inkjet head, such as a heating element type head and a piezoelectric element type head. The heating element type inkjet head generates bubbles in the ink by supplying electric power to the heating elements in the ink flow path, and ejects ink pushed by the bubbles from the nozzles. The piezoelectric element type inkjet head ejects ink stored in an ink chamber by utilizing deformation of a piezoelectric element. As a piezoelectric element type inkjet head using a piezoelectric element, a driving substrate made of a piezoelectric material is known.

An inkjet head includes an ink pressure chamber containing ink, and a driving substrate having a drive element attached thereto is disposed at one end portion of the ink pressure chamber. A nozzle for ejecting ink is also formed on the driving substrate. Then, the drive element is used to deform the driving substrate, and the ink is ejected by utilizing the change in the pressure in the ink pressure chamber. In order to protect the driving element from corrosion caused by moisture in the air, the driving substrate surface is coated by a protective layer.

A flexible wiring substrate for receiving an electric signal supplied from the controller of the inkjet apparatus is connected to the driving substrate. In the driving substrate, a connection portion electrically connected to the flexible wiring substrate is often sealed by a sealing agent. As the sealing agent, an epoxy-based resin which is resistant to the ink and has a hardness enough to withstand the wiping operation is used. Since it is difficult to finely adjust the amount of the sealing agent to be applied, unevenness may occur in the height of the ejecting surface (i.e., the surface of the driving substrate) by the solidified sealing agent. As a result, a need for spacing the liquid ejecting head from the recording medium occurs, which causes a reduction in printing accuracy.

DETAILED DESCRIPTION

In general, according to one embodiment, a liquid ejecting head comprises a driving substrate including a driving element configured to, in response to a signal from an external controller, expand or contract so that a liquid is discharged from a pressure chamber through a nozzle, and a connection portion connecting the driving element to a wiring substrate connectable to the external controller, a sealing member that covers the connection portion and a part of the wiring substrate, and a mask plate partially covering a part of the driving substrate including the connection portion and contacting the sealing member.

Figure 1:
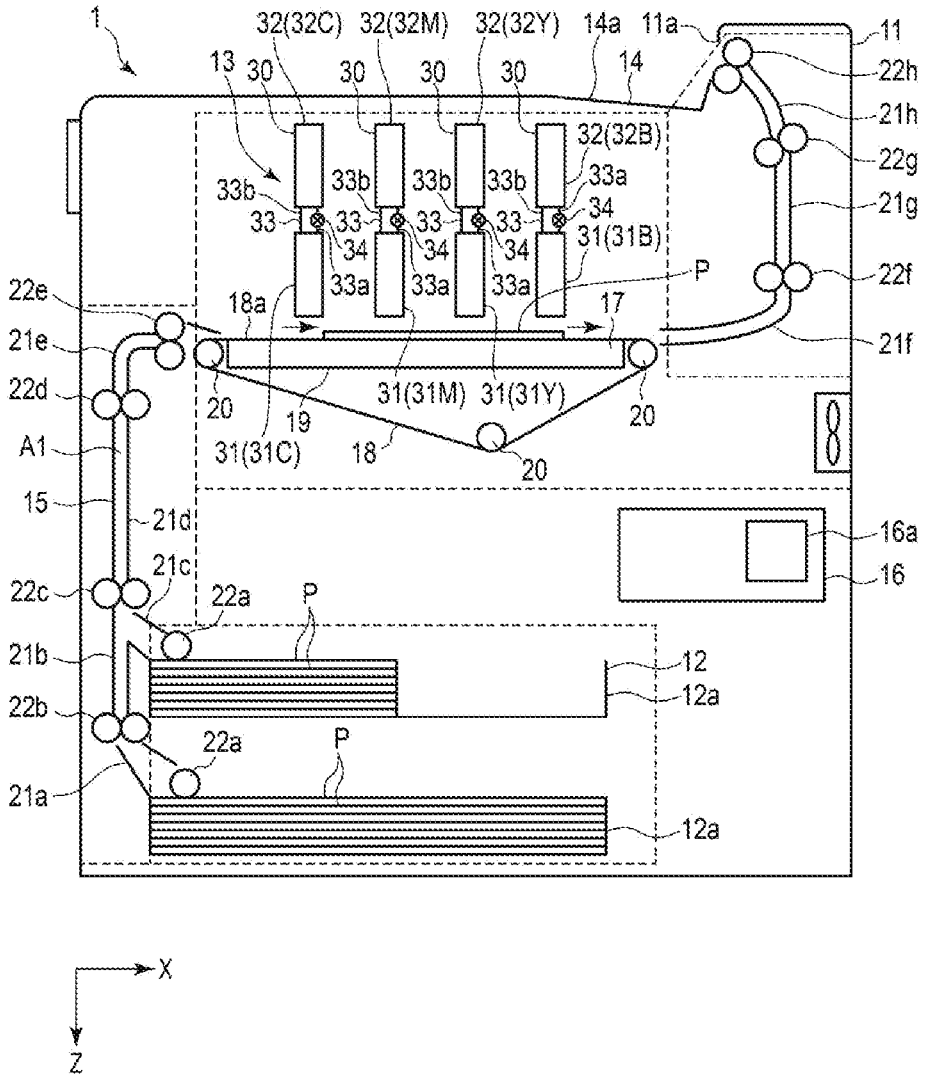
FIG. 1 is a diagram of an inkjet apparatus according to a first embodiment of the present invention.
Figure 2:
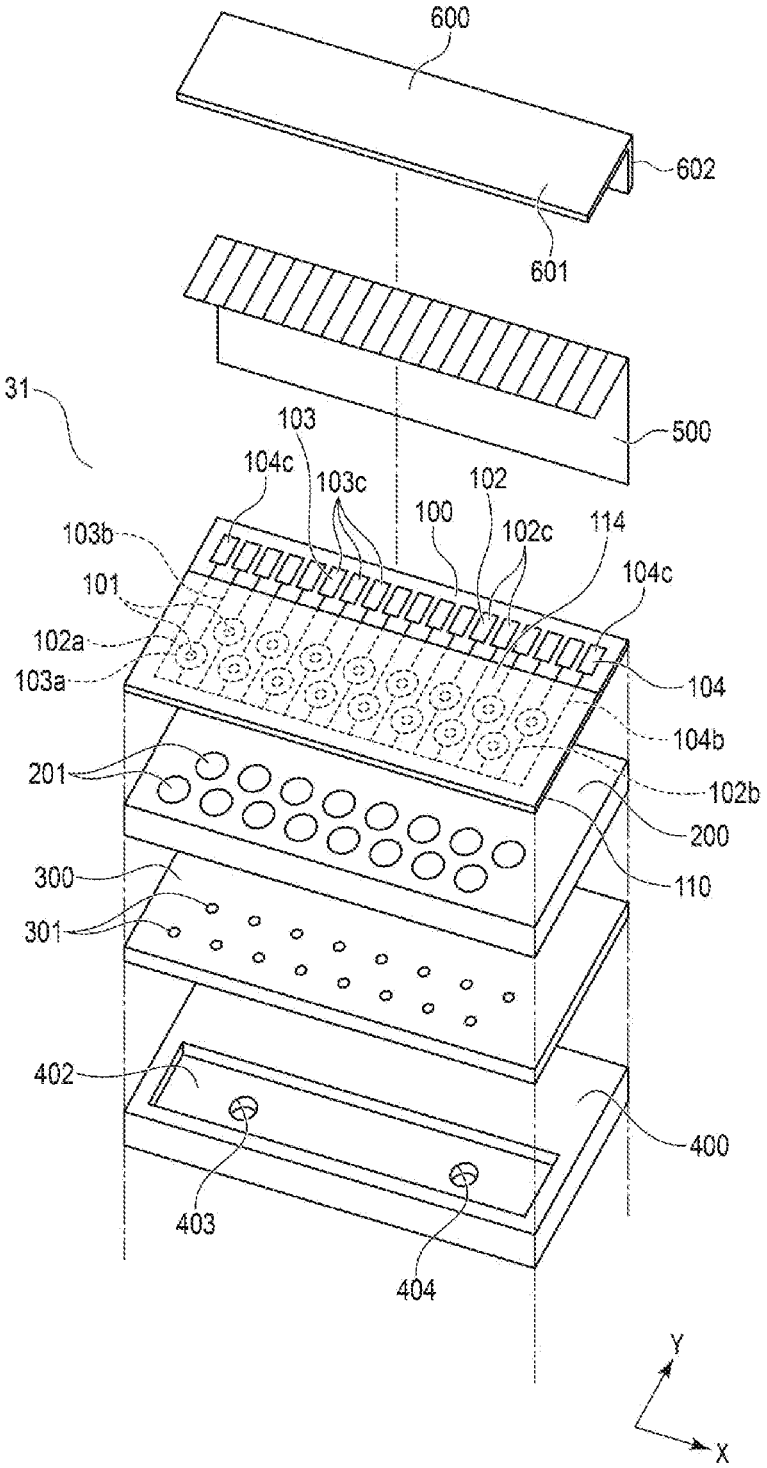
FIG. 2 is an exploded perspective view of an inkjet head according to the first embodiment.
Figure 3:
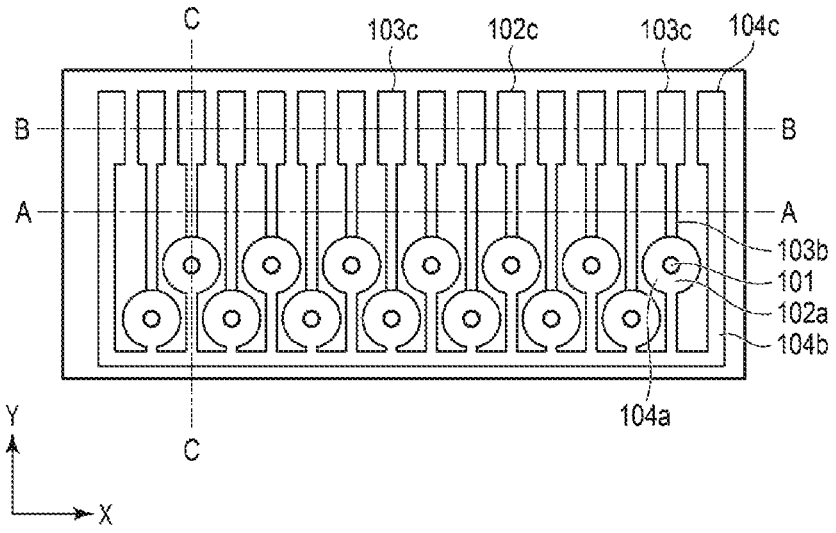
FIG. 3 is a plan view of a driving substrate of the inkjet head.
Figure 4:
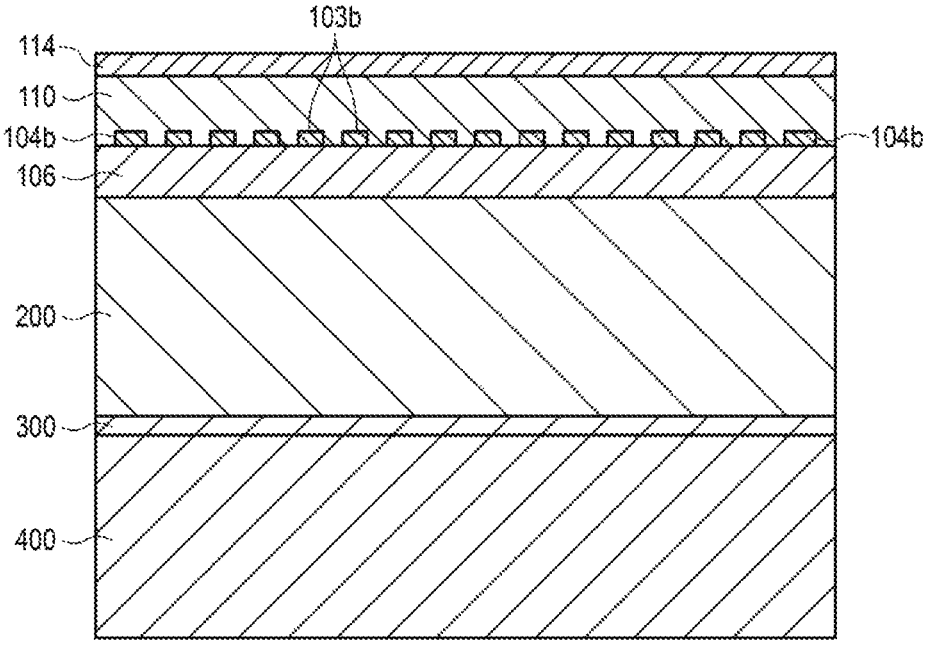
FIG. 4 is a cross-sectional view of the inkjet head.
Figure 5:
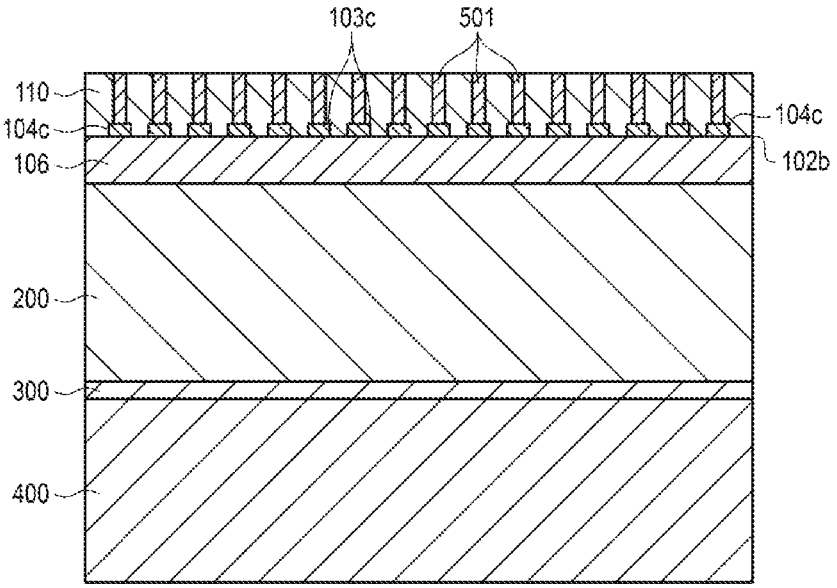
FIG. 5 is a cross-sectional view of the inkjet head.
Figure 6:
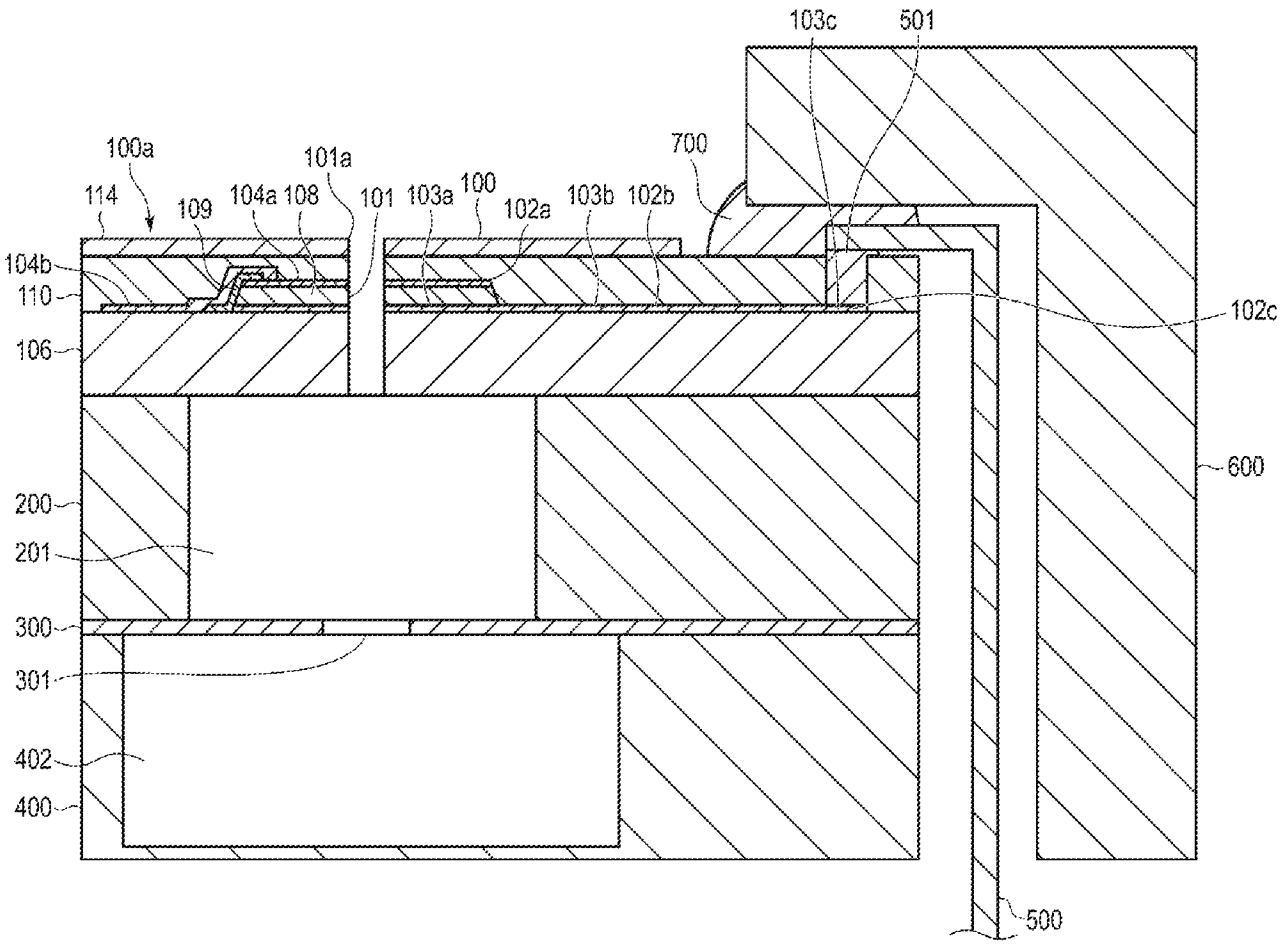
FIG. 6 is a cross-sectional view of the inkjet head.

The structure of an inkjet apparatus 1 as a liquid ejecting apparatus according to a first embodiment and a inkjet head 31 as a liquid ejecting head will now be described with reference to FIG. 1 to FIG. 6. FIG. 1 is a diagram of the inkjet apparatus 1. FIG. 2 is an exploded perspective view of the inkjet head 31. FIG. 3 is a plan view of the driving substrate. FIGS. 4, 5 and 6 are sectional views of the inkjet head 31, and show cross-sectional views taken along line A-A, line B-B and line C-C in FIG. 3, respectively. Each of the drawings schematically shows an embodiment of the present invention, and one or more components may be enlarged, reduced, or omitted.

As shown in FIG. 1, the inkjet apparatus 1 includes a housing 11, a media supply unit 12, an image forming unit 13, a medium discharge unit 14, a feeding device 15, and a control unit 16.

The inkjet apparatus 1 is an on-demand type inkjet recording apparatus that ejects ink droplets from a nozzle in accordance with an image signal while conveying a sheet P as a recording medium along a predetermined conveyance path A1 from a medium supply unit 12 through an image forming unit 13 to a medium discharge unit 14, and forms an image based on the ink droplets on the sheet P.

The housing 11 is an outer shell of the inkjet apparatus 1. The housing 11 includes a discharge port 11*a* for discharging the sheet P to the outside at a predetermined position.

The medium supply unit 12 includes a plurality of paper feed cassettes 12*a* and 12*a*. The plurality of paper feed cassettes 12*a* are provided in the housing 11. The plurality of paper feed cassettes 12*a* are formed in a box shape having a predetermined size on which the upper side is open, and are able to hold a plurality of sheets P of various sizes.

The medium discharge unit 14 includes a sheet discharge tray 14*a*. Sheet discharge tray 14*a* is provided in the vicinity of the house port 11*a* of housing 11. The sheet discharge tray 14*a* holds the sheet P discharged from the disk shelf port 11*a*.

The image forming unit 13 includes a supporting portion 17 for supporting the sheet P and a plurality of head units 30 disposed above the supporting portion 17.

The supporting part 17 includes a conveying belt 18 provided in a loop shape in a predetermined region for performing image formation, a supporting plate 19 for supporting the conveying belt 18 from the back side, and a plurality of belt rollers 20 provided on the back side of the conveying belt 18.

The supporting portion 17 supports the sheet P on the holding surface 18*a* which is the upper surface of the conveying belt 18 during image formation, and conveys the conveying belt 18 at a predetermined timing by the rotation of the belt roller 20, thereby conveying the sheet P to the downstream side.

The head unit 30 includes a plurality of inkjet heads (e.g., four color inkjet heads), an ink tank 32 as a liquid tank mounted on each inkjet head 31, a connection channel 33 connecting the inkjet head 31 and the ink tank 32, and a circulation pump 34 serving as a circulation portion. The head unit 30 is a circulation type head unit that constantly circulates liquid in the ink tank 32 and a common chamber 402 and a pressure chamber 201 formed in the inkjet head 31. In this embodiment, four color inkjet heads 31C, 31M, 31Y and 31B (i.e., cyan, magenta, yellow and black) are provided, and ink tanks 32C, 32M, 32Y and 32B are provided as ink tanks 32 for accommodating the inkjet heads 31C, 31M, 31Y and 31B. Each ink tank 32 is connected to the corresponding inkjet head 31 by a connection channel 33. The connection channel 33 includes a supply channel 33*a* connected to the ink supply port 403 of the inkjet head 31, and a recovery channel 33*b* connected to an ink discharge port 404 of the inkjet head 31.

Further, a negative pressure control device such as a pump (not shown) is connected to the ink tank 32. Then, the ink tank 32 is subjected to negative pressure control in accordance with the head value of the inkjet head 31 and the ink tank 32, thereby forming a meniscus of ink supplied to each nozzle of the inkjet head 31.

The circulation pump 34 is a liquid feed pump such as a piezoelectric pump. The circulation pump 34 is provided in the supply channel 33*a*. The circulation pump 34 is connected to the drive circuit of the control unit 16 by wiring, and is controlled by a CPU (central processing unit) 16*a*. The circulation pump 34 circulates the liquid in a circulation channel including the inkjet head 31 and the ink tank 32.

The conveying device 15 conveys the sheet P along the conveying path A1 from the paper feed cassette 12*a* of the medium supply unit 12 through the image forming unit 13 to the sheet discharge tray 14*a* of the medium discharge unit 14. The conveying device 15 includes a plurality of guide plate pairs 21*a*-21*h* along the conveyance path A1, and a plurality of conveyance rollers 22*a*-22*h*.

The guide plate pairs 21*a*-21*h* each include a pair of plate members arranged opposite to each other across the sheet P to be conveyed, and guides the sheet P along the conveyance path A1.

The conveyance rollers 22*a*-22*h* includes a paper feed roller 22*a*, conveyance roller pairs 22*b*-22*g*, and a discharge roller pair 22*h*. The conveyance rollers 22*a*-22*h* are driven by the control of the CPU 16*a* of the control unit 16 to rotate, whereby the paper P is sent to the downstream side along the conveyance path A1. In addition, one or more sensors for detecting a conveyance state of the sheet P is disposed along the conveyance path A1.

The control unit 16 includes the CPU 16*a*, a ROM for storing various programs, a RAM for temporarily storing various variable data and image data, and an interface circuit for inputting data from the outside and outputting data to the outside.

One inkjet head 31 included in the inkjet apparatus 1 according to the present embodiment will be described below. It should be noted that each of the figures is a schematic diagram for promoting the understanding of the embodiments and the understanding thereof, and the shapes and dimensions thereof, the ratio thereof, and the like are different from those of the embodiments, but the design change can be appropriately made.

The inkjet head 31 shown in FIG. 2 includes a driving substrate 100, a pressure chamber base 200, a separation plate 300, a channel base 400, a flexible wiring substrate 500, and a mask plate 600.

As shown in FIGS. 2 to 6, the driving substrate 100 includes a diaphragm 106 formed with a driving unit 102, a protection layer 110, and an ink repellent film 114 stacked on each other, and has a plurality of nozzles 101 extending in the thickness direction.

The diaphragm 106 is a layer formed on the pressure chamber base 200, and is formed in a rectangular plate shape with, for example, a thermal oxide SiO2 film (silicon dioxide). The thickness of the diaphragm 106 is preferably in the range of 1-50 μm. Instead of SiO2, other materials such as SiN (silicon nitride), $Al_2O_3$ (aluminum oxide), $HfO_2$ (hafnium oxide), and DLC (Diamond-Like Carbon) may also be used. The material selection of the diaphragm 106 is performed in consideration of heat resistance, insulation properties, thermal expansion coefficient, smoothness and wettability to ink. When ink having high conductivity is ejected by the inkjet head 31 having a low insulation property diaphragm 106, a current may flow into the ink by a voltage for driving the drive element 102*a*, and the conductive ink may be electrolyzed. Due to the electrolysis of ink, there is a possibility that the ink decomposed into the driving element adheres to the driving element, thereby deteriorating the characteristics of the inkjet head 31. Therefore, in view of the fact that an ink having a high conductivity like an aqueous ink is used, it is preferable that a resistivity of the diaphragm 106 is higher. A plurality of nozzles 101 penetrating in the thickness direction are formed in a predetermined portion of the diaphragm 106.

The nozzle 101 has a cylindrical shape having a diameter of 20 μm in which the diaphragm 106, the drive element 102*a*, the protection layer 110 and the ink repellent film 114 are laminated in the thickness direction of the driving substrate 100. Since the diaphragm 106 is made of a material having a lyophilic property, the meniscus of the ink contained in the pressure chamber 201 is kept in the nozzle 101.

The plurality of nozzles 101 are arranged in one or more rows. In the present embodiment, the plurality of nozzles 101 are arranged along a predetermined first direction in two rows. In order to arrange the nozzles 101 at a higher density, the nozzles 101 are arranged in a staggered shape. As shown in FIG. 3, the plurality of nozzles 101 are linearly arranged in the X-axis direction, and two rows of the nozzles 101 are arranged in the Y-axis direction. The center-to-center distance between the nozzles 101 adjacent to each other in the X-axis direction is 340 μm. In the Y-axis direction, the arrangement interval of the two rows of the nozzles 101 is 240 μm. In this manner, a first electrode 103, which will be described later, is formed between the two driving elements 102*a* in the X-axis direction. The nozzles 101 may be arranged in three or more rows.

The driving unit 102 includes the first electrode 103, a piezoelectric film 108, a second electrode 104, and an insulating film 109, and is formed on the diaphragm 106.

As shown in FIG. 6, the piezoelectric film 108 is patterned in a circular shape in accordance with the pressure chamber 201, and has a circular opening concentric with the nozzle 101. That is, the piezoelectric film 108 surrounds the ejecting side opening of the nozzle 101 at a concentric circle with the ejecting side opening of the nozzle 101. When the piezoelectric film 108 is formed, polarization is generated in the film thickness direction. When an electric field in the same direction as the polarization direction is applied to the piezoelectric film 108 through the electrode, the driving element 102*a* expands and contracts in a direction orthogonal to the electric field direction. The diaphragm 106 is deformed in the thickness direction of the driving substrate 100 according to the expansion and contraction to generate pressure change in ink in the pressure chamber 201.

The plurality of first electrodes 103 are connected to the piezoelectric film 108, and are formed on the piezoelectric film 108 in the side of the pressure chamber 201. In other words, the first electrodes 103 are formed on the surface of the diaphragm 106 opposite to the pressure chamber 201. Each first electrode 103 includes a circular first electrode portion 103*a* a having a diameter larger than that of the circular piezoelectric film 108, a first wiring portion 103*b*, and an electrode terminal portion 103*c* serving as a connection portion 102*c*. Each first electrode 103 is individually connected to the piezoelectric film 108 of the corresponding drive element 102*a*, and transmits a signal for driving the drive element 102*a*. That is, each first electrode 103 acts as an individual electrode for independently operating the piezoelectric film 108.

The second electrode 104 are also connected to the piezoelectric film 108 of the driving element 102*a*, and are formed on the ejecting side with respect to the piezoelectric film 108. Each second electrode 104 includes a circular second electrode portion 104*a* a having a diameter smaller than that of the circular piezoelectric film 108, a second wiring portion 104*b*, and a second electrode terminal portion 104*c* serving as a connection portion 102*c*. The second electrodes 104 are commonly connected to the piezoelectric film 108 corresponding to each of the driving elements 102*a*, and acts as a common electrode.

The driving unit 102 formed as described above includes the circular driving element 102*a* surrounding the nozzle 101, the wiring portions 103*b* and 104*b* connected to the driving element 102*a*, and the terminal portions 103*c* and 104*c*. The driving element 102*a* is formed by laminating the first electrode portion 103*a* which is a part of the first electrode 103, the piezoelectric film 108, and the second electrode portion 104*a* which is a part of the second electrode 104 on the diaphragm 106. The wiring portions 102*b* are formed by the first wiring portions 103*b* and the second wiring portions 104*b*. Each of the first wiring portions 103*b* is a part of the corresponding first electrode 103 formed on the diaphragm 106. The second wiring portions 104*b* is part of the second electrode 104. The connection portion 102*c* is formed by the electrode terminal portion 103*c* and the second electrode terminal portion 104*c*. The electrode terminal portion 103*c* is a part of the first electrode 103. The second electrode terminal portion 104*c* is a part of the second electrode 104. The flexible substrate 500 is connected to the first electrode terminal portion 103*c* and the second electrode terminal portion 104*c*, which are the connection portions 102*c*, via an anisotropic conductive film 501.

The first electrode portions 103*a* are formed in a circular shape, and a through hole forming the nozzle 101 is formed in the center of each of the first electrode portion 103*a*.

The first wiring portions 103*b* are formed in a predetermined pattern shape for connecting the first electrode portions 103*a* and the first electrode terminal portions 103*c*.

The first electrode terminal portions 103*c* are each formed at an end portion of the first wiring portion 103*b*. The anisotropic conductive film 501 is disposed in a space formed by etching the protection layer 110 at a predetermined portion on the first electrode terminal portions 103*c*, whereby the first electrode terminal portions 103*c* and the flexible substrate 500 are electrically connected to each other via the anisotropic conductive film 501. Each of the first electrode terminal portions 103*c* is a part of the first electrode 103, and receives a signal for driving the inkjet head 31 from the outside of the inkjet head 31.

The second electrode portions 104*a* are formed in a circular shape, and a through hole forming the nozzle 101 is formed in the center of each of the second electrode portion 104*a*.

The second electrode portions 104*b* are formed in a predetermined pattern shape for connecting the second electrode portions 104*a* and the second electrode terminal portions 104*c*. The second wiring portions 104*b* extend from the drive elements 102*a* to the opposite side of the extension direction of the first wiring portions 103*b*, extend in the X-axis direction of the substrate 100, and extend along a in the Y-axis direction of the driving substrate 100 to reach the first terminal portions 103*c* on the both sides on the driving substrate 100.

The second electrode terminal portion 104*c* is formed at an end portion of the second wiring portion 104*b*. An anisotropic conductive film 501 is disposed in a space formed by etching the protection layer 110 at a predetermined portion on the second electrode terminal portion 104*c*, thereby electrically connecting the second electrode terminal portion 104*c* and the flexible substrate 500 via the anisotropic conductive film 501. The second electrode terminal portion 104*c* is a part of the second electrode 104, and receives a signal for driving the drive element 102*a* from the external drive circuit.

Since the first wiring portions 103*b* and the second wiring portions 104*b* are wired through the driving elements 102*a*, the wiring width is about 80 μm in this embodiment. The connection portion 102*c* composed of the first electrode terminal portion 103*c* and the second electrode terminal portion 104*c* is covered by a sealing member 700, and is covered by the mask plate 600.

The second electrode terminal portions 104*c* are disposed on both sides of the first electrode terminal portions 103*c* which are parallel to each other in the X-axis direction. The interval between the first electrode terminal portions 103*c* is 170 μm in the X-axis direction of the nozzles 101 because the nozzles 101 are arranged in a staggered arrangement, so that the width in the X-axis direction of the second electrode terminal portions 104*c* can be made wider than the width of the first electrode 103. Therefore, the connection to the external drive circuit is facilitated. The external driving circuit is an IC that selectively applies a voltage between the first electrode 103 and the second electrode 104 according to the image signal, thereby ejecting ink from the nozzle 101.

The protection layer 110 is formed on the diaphragm 106 on which the driving unit 102 is formed. The protective layer 110 preferably has a thickness in a range of 1-50 μm. As an example, the protection layer 110 of the present embodiment is formed of polyimide having a thickness of 3 μm. The protection layer 110 covers the drive element 102*a* and the wiring portions 102*b*, but is not formed on the connection portion 102*c*. The protection layer 110 is formed in a region of the ejecting side surface of the diaphragm 106 except for the electrode terminal portions 102*c* and 103*c* of the connection portion 104*c*. An ink repellent film 114 is formed on the protection layer 110.

The ink repellent film 114 is formed of a liquid ink repellent film material, and is formed at a predetermined portion on the protection layer 110. The ink repellent film 114 is formed in a predetermined region covering at least the drive element 102*a*, and the ink repellent film 114 covers at least a part of the drive element 102*a* and the wiring portions 102*b*, but is not formed on the connection portion 102*c*. In the present embodiment, the ink repellent film 114 is formed in a region extending from an edge on one end side of the driving substrate 100 to the vicinity of the edge of the mask plate 600. The ink repellent film 114 prevents ink from remaining on the protection layer 110 and returns the ink adhered to the protection layer 110 to the nozzle 101.

The ink repellent film 114 is made of a silicon liquid-repellent material having liquid repellency and a fluorine-containing organic material, and in the present embodiment, Cytop (registered trademark), which is a fluorine-containing organic material manufactured by Asahi Glass Co., Ltd., is used as the ink repellent film. The film thickness of the ink repellent film 114 is set to 1 μm in the present embodiment.

The sealing member 700 is formed of a sealing agent disposed on the connection portion 102*c*. The sealing member 700 covers and seals the bonding portion where the flexible wiring substrate 500 is bonded to the electrode terminal portions 103*c* and 104*c* as the connection portions 102*c* exposed from the protection layer 110 to the ejecting side via the anisotropic conductive film 501. As the sealing agent, for example, an epoxy resin or a silicone sealing agent having a hardness which is resistant to ink and which is capable of withstanding wiping operation is used.

The mask plate 600 is a part of the outer periphery of the inkjet head 31. The mask plate 600 is formed by bending a plate member made of a metal material, such as SUS (Stainless Steel) material. The mask plate 600 has an L-shaped cross section with a top plate portion 601 covering a predetermined area on the discharge surface 100*a* of the driving substrate 100, and a side plate portion 602 disposed on the outer periphery of the driving substrate 100. The surface of the mask plate 600 is subjected to a water repellent treatment. In the mask plate 600, the top plate portion 601 covers the connection portion 102*c* and the ejecting surface 100*a* side of the connection portion to which the flexible wiring substrate 500 is electrically connected with the sealing member 700 interposed therebetween, and the side plate portion 602 covers the flexible wiring substrate 500 at the peripheral portions of the pressure chamber base 200, the separation plate 300, and the channel base 400. The shape of the sealing member 700 is defined by the mask plate 600.

At least a surface of the mask plate 600 on the ejecting side of the top plate portion 601 is formed to be flat. In the manufacturing process described later, the positional relationship between the mask plate 600 and the diaphragm 106 is set, whereby the step level of the ejecting surface 100*a* of the inkjet head 100 can be defined. In this embodiment, the thickness of the mask plate 600 is 0.1 mm, the level difference between the surface on the ejecting side of the top plate portion 601 and the surface of the ink repellent film 114 on the driving element 102*a* is 0.1-0.2 mm, and the height of the sealing member 700 is suppressed to several tens μm. The sealing member 700 is entirely or largely disposed in a gap between the mask plate 600 and the driving substrate 100, and is in a retracted positional relationship to the side opposite to the ejecting side, that is, toward the pressure chamber side, from the surface on the ejecting side of the top plate portion 601 of the mask plate 600.

The pressure chamber base 200 is a rectangular block member formed by a silicon wafer, and has a thickness of 300 μm. A plurality of pressure chambers 201 are respectively formed at positions corresponding to the plurality of nozzles 101 in the pressure chamber base 200. Each of the pressure chambers 201 has a cylindrical shape, and communicates with the corresponding nozzle 101. Each pressure chamber 201 holds ink for printing an image on a printing medium, e.g., a paper sheet, a plastic film, or the like, and supplies ink into the corresponding nozzle 101 due to a volume change.

The separate plate 300 is a metal plate member, and is disposed on a surface of the pressure chamber base 200 opposite to the driving substrate 100. The separate plate 300 is formed of stainless steel and has a rectangular shape having a thickness of 200 μm. The separate plate 300 is formed with a throttle 301 which is a through hole connected to the pressure chamber 201. The shape of the throttle 301 is formed such that the fluid resistance of the ink restriction to the respective pressure chambers 201 is substantially equal. The throttle 301 serves to confine the pressure generated in the pressure chamber 201 to prevent the pressure from escaping to the common chamber 402. Therefore, the diameters of throttle 301 may be equal to or smaller than quarter of the diameter of the pressure chamber 201.

The channel base 400 is a plate made of stainless steel having a thickness of 4 mm. The channel base 400 includes a common chamber 402, an ink supply port 403, and an ink ejecting port 404.

The common chamber 402 is a recess formed on a surface opposite to the separation plate 300. The common chamber 402 is formed in a region opposed to the region including all the pressure chambers 201, and communicates with all of the pressure chambers 201 so as to be able to supply ink. That is, the common chamber 402 is sized to allow ink to be supplied to all of the pressure chambers 201 through the throttle 301 at the same time.

The ink supply port 403 and the ink ejecting port 404 are through holes that communicate with the common chamber 402 and penetrate the channel base 400 in the thickness direction. The ink supply port 403 and the ink ejecting port 404 are disposed near both ends of the common chamber 402, respectively.

The pressure chamber base 200, the separation plate 300, and the channel base 400 are fixed to each other with an epoxy adhesive so as to maintain a predetermined positional relationship between the nozzle 101 and the pressure chamber 201.

In the head unit 30 of the inkjet apparatus 1 configured as described above, the ink in the ink tank 32 is supplied from the ink supply port 403 to the common chamber 402 through the supply channel 33*a*. The ink in the common chamber 402 flows into each of the pressure chambers 201 through the throttle portion 301, and is filled in each of the nozzles 101. The ink supplied from the ink supply port 403 is maintained at a proper negative pressure. The ink in the nozzle 101 is kept from leaking out of the nozzle 101. Then, due to deformation of a portion of the driving substrate 100 corresponding to the pressure chamber 201, pressure changes in the ink in the pressure chambers 201, and ink is ejected from the nozzles 101. The ink in the common chamber 402 is ejected from the ink ejecting port 404 to the recovery channel 33*b*, and returns to the ink tank 32, and the ink is circulated between the ink tank 32 and the inkjet head 31. The ink is circulated through the common chamber 402, whereby the ink temperature in the common chamber 402 can be kept constant.

Figure 7:
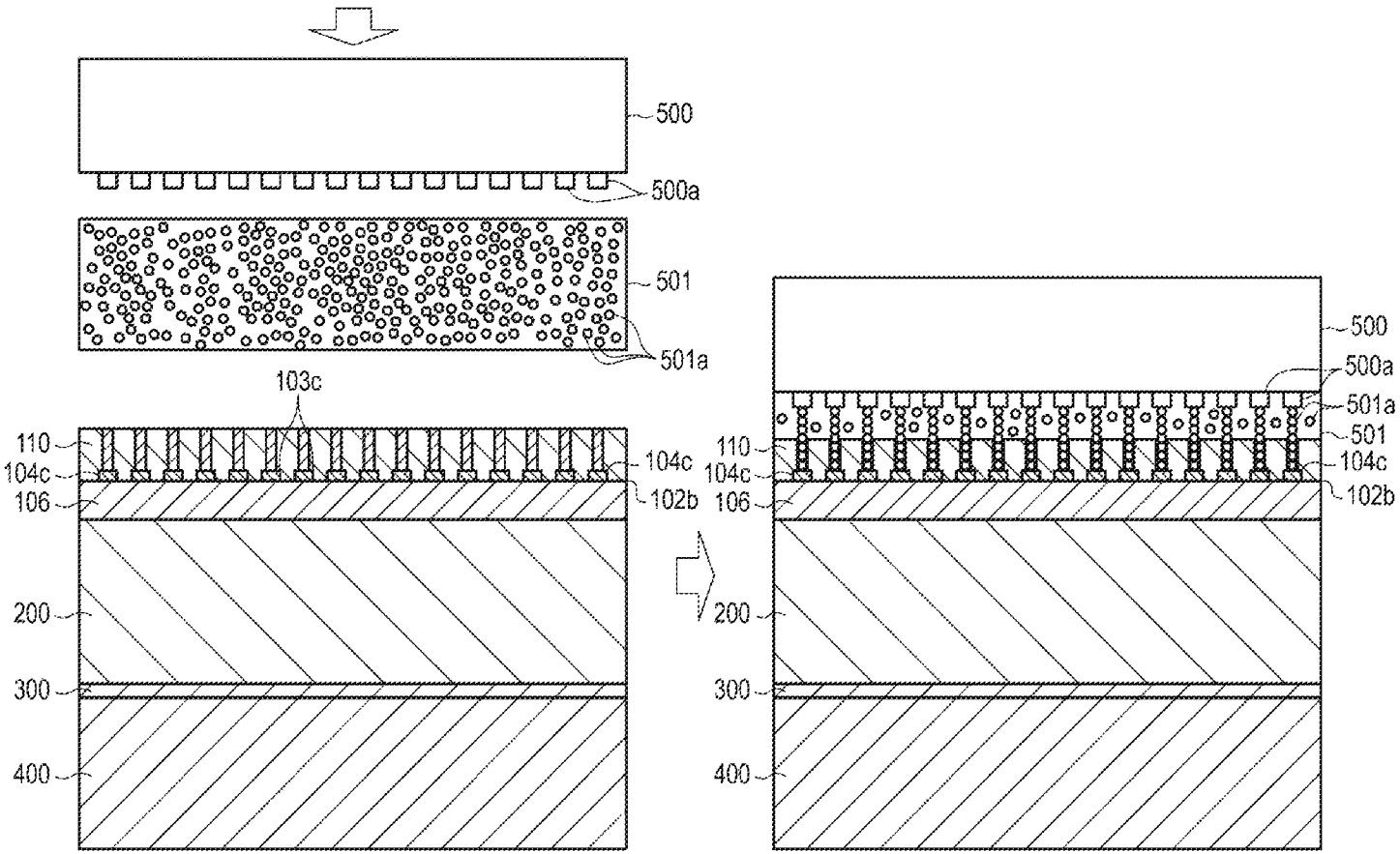
FIG. 7 is a diagram explaining a method of manufacturing the inkjet head.

Next, a method for manufacturing the inkjet head 31 will be described with reference to FIGS. 2 to 7. FIG. 7 is a diagram explaining a method for manufacturing the inkjet head 31, and shows a wiring connection process by thermal compression bonding.

The driving substrate 100 is formed by a thin film or spin coating of a material constituting the inkjet head 31. In this embodiment, a structure is shown in which a film of the diaphragm 106 is formed on the pressure chamber base 200. A mirror-polished silicon wafer is used for the pressure chamber base 200 to form a driving substrate 100. In the process for forming the driving substrate 100, a silicon wafer having heat resistance is used for repeating heating and film formation of a thin film. The silicon wafer has a thickness of 100-775 μm, for example, according to SEMI (Semiconductor Equipment and Materials International) standards. Instead of a silicon wafer, it is also possible to use a ceramic having heat resistance, quartz or a substrate made of various metals.

The diaphragm 106 is formed by a thermal oxide SiO2 film (silicon dioxide) deposited on the surface of a silicon wafer by heat-treating a silicon wafer in an oxygen atmosphere. A film having a thickness of 4 μm is formed on the entire surface of the pressure chamber base 200. In addition to the heat treatment, a chemical vapor deposition method such as CVD may be used as the formation of the diaphragm 106.

The first electrode 103 is formed of a Pt (platinum)/Ti (titanium) thin film. In the present embodiment, the thin film is formed to have a thickness of 0.1 μm by a sputtering method. As another electrode material of the first electrode 103, Ni (nickel), Cu (copper), Al (aluminum), Ti (titanium), W (tantalum), Mo (molybdenum), Au (gold), or the like can be used. As another film formation method, vapor deposition or plating may be used. The first electrode 103 has a desired thickness of 0.01-1 μm.

The piezoelectric film 108 is formed by an RF (radio frequency) magnetron sputtering method using PZT (lead zirconate titanate). As other materials, PTO ($PbTiO_3$: lead titanate) PMNT (Pb(Mg(Mg1/3 Nb2/3)O3-PbTiO3), PZNT (Pb (Zn1/3Nb2/3)O3PbTiO3), ZnO, AlN and the like can also be used. As another method of manufacturing, a CVD method, a sol-gel method, an AD method (aerosol deposition method), a hydrothermal synthesis method, or the like can also be used. The thickness of the piezoelectric film is determined by piezoelectric characteristics, breakdown voltage, and the like. The thickness of the piezoelectric film is approximately 0.1-5 μm, and is set to 2 μm in the present embodiment. When the PZT thin film is formed, polarization is generated along the film thickness direction from the first electrode 103. That is, the PZT film is polarized in the normal direction with respect to the plane of diaphragm 106.

The second electrode 104 is formed of a platinum (Pt) thin film. The thin film is formed to have a thickness of 0.1 μm by a sputtering method. As other electrode materials of the second electrode 104, Ni, Cu, Al, Ti, W, Mo, Au and the like can also be used. As another film formation method, vapor deposition or plating may be used. The second electrode 104 has a desired thickness of 0.01-1 μm.

After the first electrode 103, the piezoelectric film 108, and the second electrode 104 are formed, each film is patterned in a shape suitable for the second electrode portion 104*a*, the piezoelectric film 108, the first electrode portion 103*a*, the first wiring portions 103*b*, and the first electrode terminal portion 103*c* which make up the driving element 102*a*. The patterning is performed by forming an etching mask on the electrode film and removing the electrode material other than the portion covered with the etching mask by etching. The etching mask is formed by applying a photosensitive resist to the electrode film, performing prebaking, exposing the mask with a mask having a desired pattern formed thereon, and performing a post-baking process through a development process.

The pattern of the piezoelectric film 108 is formed to have a circular shape having an outer diameter of 140 μm. The first electrode portion 103*a* is formed to have a circular pattern having an outer diameter of 150 μm and a larger outer diameter than the outer diameter of the piezoelectric film 108. The second electrode portion 104*a* is formed to have a circular pattern having an outer diameter of 128 μm and an outer diameter smaller than the outer diameter of the piezoelectric film. That is, the surface area satisfies the following relationship: the first electrode portion 103*a*≥the piezoelectric film 108≥the second electrode portion 104*a*. Since the nozzle 101 is formed at the center of the circular piezoelectric film 108, a portion where no electrode film having a diameter of 40 μm is formed from the center of the piezoelectric film 108 is formed, and the diaphragm 106 is exposed.

In order to maintain insulation between the first electrode 103 and the second electrode 104, the insulating layer 109 is formed on the surface of the piezoelectric layer 108 and the second electrode 104, and is formed at a predetermined position overlapping with the first electrode 103. In the present embodiment, the insulating film 109 has a thickness of 0.5 μm, and the material is SiO2. The film formation is carried out by a CVD method in which a good insulating property is formed at a low temperature. An amount of the insulating film 109 covering the driving element 102*a* is set to such an extent that the deformation amount of the piezoelectric film 108 is not inhibited.

Subsequently, the diaphragm 106, the second wiring portion 104*b* connected to the second electrode portion 104 on the insulating film 109, and the second electrode terminal portion 104*c* are formed by a sputtering method. In the present embodiment, the wiring portions includes a portion of the second electrode 104, and the material is Au having a thickness of 0.3 μm. As other film forming materials of the second wiring portions 104*b*, Cu, Al, Ag, Ti, W, Mo, Pt and Au can be used. As other methods for forming the second wiring portions 104*b*, vacuum evaporation, plating or the like can be used. The thickness of the second wiring portions 104*b* is preferably in a range of 0.01-1 μm. At this time, the outer peripheral portion of the stacked structure of the first electrode portion 103*a*, the piezoelectric film 108, and the second electrode portion 104*a* gradually decreases in diameter from the lower side to the upper side, and therefore, since the taper angle is loosely processed, the wiring portions 104*b* of the second electrode 104 over the insulating film 109 on the outer periphery of the driving element 102*a* are prevented from being bent substantially at right angles, thereby suppressing disconnection.

The protection layer 110 is formed on the diaphragm 106, the first electrode 103, the second electrode 104, and the insulating film 109. The protection layer 110 is formed of polyimide and has a thickness of 3 μm. The protection layer 110 is formed by forming a solution containing a polyimide precursor by a spin coating method, and then performing thermal polymerization and solvent removal by baking. By forming the film by the spin coating method, a film having a smooth surface is formed by covering the drive element 102*a* formed on the diaphragm 106, the first electrode 103, and the second electrode 104. As another film forming method, CVD, vacuum vapor deposition, plating, or the like can be used.

In the present embodiment, Young's modulus of the SiO2 film of the diaphragm 106 is 80.6 GPa, Young's modulus of the polyimide film of the protection layer 110 is 10.9 GPa.

Since a difference between Young's modulus is 69.7 GPa, deformation amount of the protective layer 110 is larger than that of the diaphragm 106. Therefore, when the driving element 102*a* contracts in a direction perpendicular to the electric field direction, the diaphragm 106 deforms in a direction in which the volume of the pressure chamber 201 is reduced. Conversely, when the drive element 102*a* extends in a direction perpendicular to the direction of the electric field, the diaphragm 106 deforms in a direction in which the volume of the pressure chamber 201 is increased. As the difference in Young's modulus between the diaphragm 106 and the protective layer 110 increases, the difference in the deformation amount of the diaphragm 106 becomes larger when the same voltage is applied to the drive element. Therefore, when the difference between the Young's moduli of the diaphragm 106 and the protection layer 110 is large, ink ejection can be performed at a lower voltage. As described above, the deformation amount of the plate affects not only the Young's modulus of the plate material but also the thickness of the plate material. Therefore, when there is a difference in the deformation amount between the diaphragm 106 and the protection layer 110, it is necessary to consider not only the Young's modulus of the material but also the film thickness of each film. Even though Young's modulus of the material of the diaphragm 106 and that of the protective layer 110 are the same, the voltage for driving the drive element 102*a* is increased, but ink ejection is possible.

In addition, in the material selection of protection layer 110, heat resistance, insulation property, thermal expansion coefficient, smoothness and wettability to ink are also taken into consideration. When the high conductivity ink is supplied to the inkjet head 31 in terms of insulation properties, it is desirable to select a high resistivity material as the protection layer 110 in order to prevent deterioration of the ink due to electrolysis. The protection layer 110 may be made of a plastic material such as ABS (acrylonitrile butadiene styrene), polyacetal, polyamide, polycarbonate or polyether sulfone as a resin material instead of polyimide. In addition, a nitride such as zirconia, silicon carbide, silicon nitride, barium titanate, or the like, or an oxide may be used as the ceramic material. Further, as another method for forming the protection layer 110, a CVD method, a vacuum deposition method, or the like can be used. The protective layer 110 preferably has a thickness in a range of 1-50 μm.

After forming the protection layer 110, dry etching is performed to remove the protection layer 110 in a predetermined area in a rectangular shape where the anisotropic conductive film 501 is disposed.

In the above description, as an etching method, a wet etching method using a chemical solution and a dry etching method using a plasma are appropriately selected. The insulating film, the electrode film, the piezoelectric film, and the like are processed by changing the etching method or etching conditions. After the etching process with each photosensitive resist film is completed, the remaining photosensitive resist film is removed by a resist removing process using a solution.

The ink repellent film 114 is formed by a liquid ink repellent film material on the protection layer 110 by spin coating. The ink repellent film 114 is a silicon liquid-repellent material having liquid repellency and a fluorine-containing organic material, and in the embodiment, Cytop (registered trademark), which is a fluorine-containing organic material manufactured by Asahi Glass Co., Ltd., is used as the ink repellent film. In the present embodiment, the film thickness of the ink repellent film 114 is set to 1 μm.

In order to prevent the ink repellent material from adhering to both end portions 104*c* and 103*c* when the ink repellent film 114 is formed, a resin tape member having an adhesive strength may be attached to the region of the first electrode terminal portion 103*c* and the second electrode terminal portion 104*c* as a cover tape.

Next, a method of patterning the pressure chamber 201 will be described. A back surface protective tape for chemical mechanical polishing (CMP) is applied to the ink repellent film 114 and the protection layer 110 to turn the pressure chamber base 200 upside down. The pressure chamber 201 is formed by removing silicon other than the etching mask by using a vertical deep trench dry etching technique called Deep-RIE dedicated to a silicon substrate. The pressure chamber 201 has a cylindrical shape having a diameter of 190 μm, and the center position of the pressure chamber 201 and the center position of the nozzle 101 are substantially aligned with each other.

Even in the inkjet head 31 having a configuration in which the center position of the pressure chamber 201 and the center position of the corresponding nozzle 101 are shifted from each other, it is possible to eject ink from the nozzle 101 by pressure generated in the pressure chamber 201. The inkjet head 31 in which the centers of the circular sections of the pressure chambers 201 and the centers of the corresponding nozzles 101 coincide with each other can make the ink ejecting direction uniform compared to the inkjet heads 31 in which those centers do not coincide with each other.

The Deep-RIE dedicated for silicon substrate uses SF6 (sulfur fluoride) as an etching gas, but the SF6 gas does not have an etching effect on the SiO2 film of the diaphragm 106 and the polyimide film of the protection layer 110. Therefore, the progress of dry etching of the silicon wafer forming the pressure chamber 201 is stopped at the diaphragm 106. That is, the SiO2 film of the diaphragm 106 plays a role of a stop layer for a Deep-RIE etching. When the pressure chamber 201 is formed in the pressure chamber base 200, the pressure chamber 201 and the nozzle 101 communicate with each other. The nozzle 101 is formed in the diaphragm 106, the protection layer 110, and the inside. With this configuration, a voltage is applied to the first electrode 103 and the second electrode 104 to operate the driving element 102*a*, so that ink can be ejected through the nozzle 101.

Next, the separation plate 300 and the channel base 400 are bonded to each other with an epoxy resin. After the separation plate 300 and the channel base 400 are adhered to each other, the separation plate 300 is adhered to the pressure chamber base 200 with an epoxy resin.

After the separation plate 300 and the channel base 400 are adhered to the pressure chamber base 200, ultraviolet light is irradiated from the back surface protective tape side to weaken the adhesive strength of the protective tape.

Next, as shown in FIG. 7, in order to connect the pressure chamber base 200 to the external driving circuit, the flexible wiring substrate 500 connected to the external driving circuit is connected to the second electrode terminal portion 104*c* and the first electrode terminal portion 103*c* via the anisotropic conductive film 501. The anisotropic conductive film 501 is a conductive film formed in a film shape in which fine metal particles are mixed with a thermosetting resin. In mounting, the anisotropic conductive film 501 is interposed between the electrode portion of the flexible wiring substrate 500 and the protection layer 110 near the electrode terminal portions 103*c* and 104*c*, and the driving substrate 100 is pressurized by a pad having elasticity such as rubber while applying heat by a heater or the like, and thermocompression bonding is performed. By thermocompression bonding, the anisotropic conductive film 501 is deformed, and the anisotropic conductive material enters into the space where the protection layer 110 is etched, and reaches the electrode terminal portions 103*c* and 104*c*. In the anisotropic conductive film 501, when pressure is applied to only a film portion to which the electrode terminal portion 500*a* of the flexible wiring substrate 500 comes into contact, the conductive particles 501*a* dispersed in the anisotropic conductive film 501 are overlapped, and then, the conductive particles 501*a* in the anisotropic conductive film 501 are stuck to each other to form a conductive path. Accordingly, by thermocompression bonding, the flexible wiring substrate 500 and the electrode terminal portions 103*c* and 104*c* are electrically connected via the conductive particles 500*a* in the anisotropic conductive film 501. Since the conductive particles 501*a* in the film portion not subjected to pressure hold the insulating layer, insulation between the electrodes arranged side by side is maintained. In other words, anisotropic anisotropy is formed in the longitudinal direction, and insulation properties are maintained in the lateral direction. Therefore, the mounting using the anisotropic conductive film 501 has an advantage that the electronic components can be mounted without causing a short circuit even when the lateral electrodes are spaced apart from each other in the lateral direction. In addition, mounting using the anisotropic conductive film 501 has a lower processing temperature at the time of mounting than solder, and a low temperature mounting at about 180° C. is possible.

In addition, in the first embodiment, in order to prevent the ink from infiltrating the connection portion 102*c*, the edge portion of the connection portion 102*c* adjacent to the ink ejecting portion 101*a* of the nozzle 101 is sealed by the sealing member 700, and the mask plate 600 covering the upper portion of the sealing member 700 is provided.

Specifically, when the mask plate 600 is bonded to the driving substrate 100, a sealing agent is applied to the inner side of the mask plate 600 to form the sealing member 700, which is fixed to the driving substrate 100. Alternatively, a sealant may be applied in advance to the vicinity of the connection portion between the driving substrate 100 and the flexible wiring substrate 500 to form the sealing member 700, and the mask plate 600 may be placed over the sealing member 700 to be press-fixed.

As the mask plate 600, a stainless steel plate subjected to a water repellent treatment is used. The water repellent treatment is, for example, two types of water repellent treatment. A first example is simply dipping the entire mask plate 600 into a water repellent agent (for example, a fast drying agent). A second example is to apply a water repellent agent to only the outer surface of the mask plate 600 (e.g., quick-drying). When the water repellent liquid is dried, a water repellent film is formed on the outer surface of the mask plate 600.

According to the inkjet head 31 and the inkjet apparatus 1 of the present embodiment, variations in the height of the ejecting surface 100*a* can be suppressed. That is, in the connection portion 102*c* of the inkjet head 31, the edge portions of the electrode terminal portions 103*c* and 104*c* close to the ink ejecting portion 101*a* are securely sealed by the sealing member 700, and the sealing member 700 is restricted by the mask plates 600, thereby suppressing the variation in the height of the sealing member 700 formed by solidifying the sealing member. That is, since the sealing member 700 is covered by the flat top plate portion 601, the height of the step portion on the ejecting surface 100*a* can be kept low. Therefore, it is possible to define the positional relationship with the recording medium, and it is possible to secure high printing accuracy.

Second Embodiment

Figure 8:
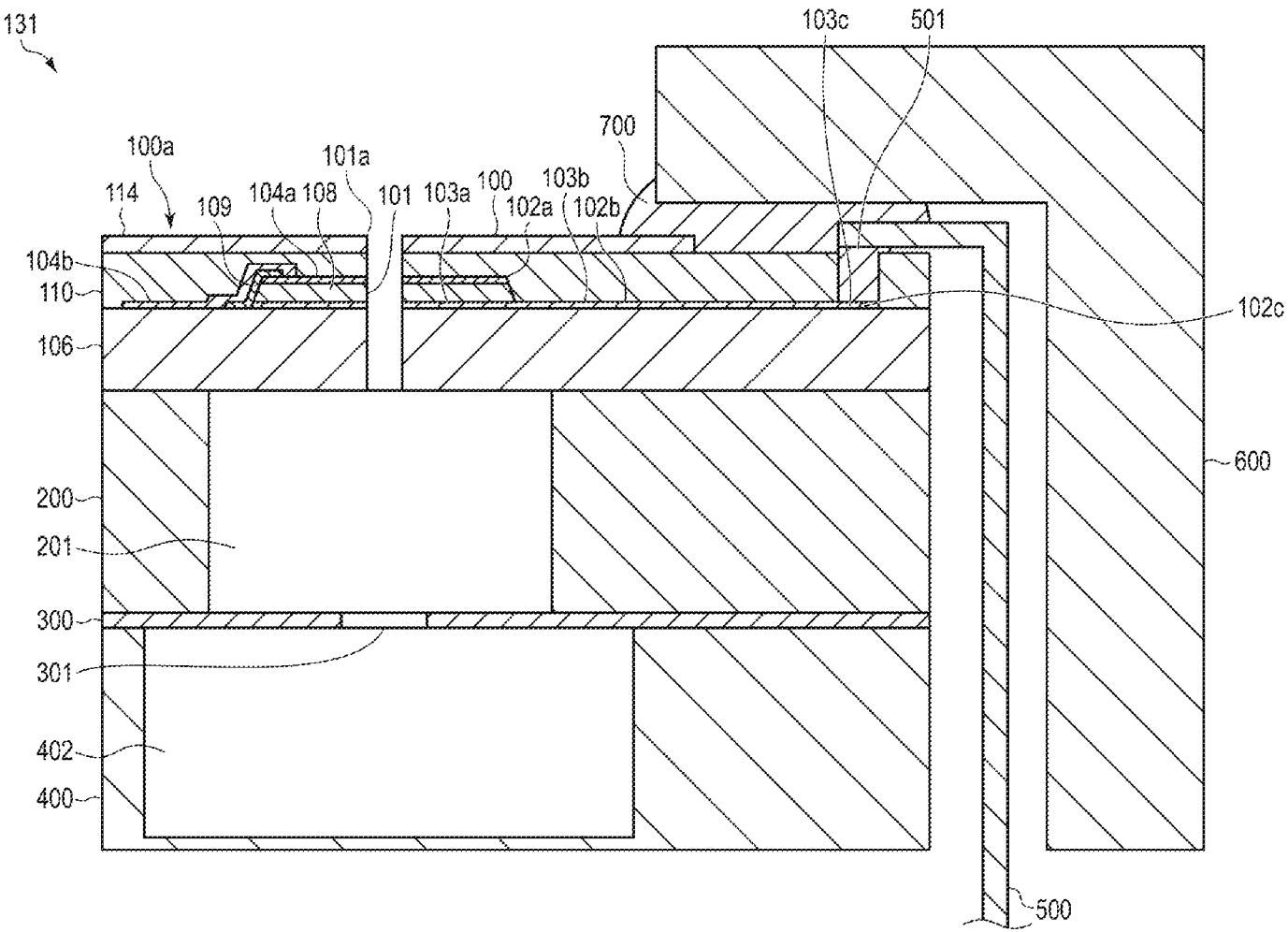
FIG. 8 is a cross-sectional view showing a part of an inkjet head according to a second embodiment.

The configuration of the inkjet head 131 according to the second embodiment will be described below with reference to FIG. 8. Although the second embodiment is the same as the inkjet head 31 according to the first embodiment, the description thereof will not be repeated.

In the inkjet head 131 according to the present embodiment, the mask plate 600 extends to the edge portion of the ink repellent film 114, and the sealing member 700 covers a part of the ink repellent film 114. More specifically, the end edge on the nozzle side of the top plate portion 601 extends to a region where the ink repellent film 114 is formed in the vicinity of the driving element 102*a*. The sealing member 700 covers the connection portion 102*c* and is disposed in a region extending to the edge portion of the ink repellent film 114. In other words, the ink repellent film 114 is formed in a region to reach the mask plate 600, and the inkjet head 131 is covered with the ink repellent film 114 and the sealing member 700 to cover the entire surface of the driving substrate 100 on the ejecting side. Also in this embodiment, all or most of the sealing member 700 is disposed in a gap between the top plate portion 601 of the mask plate 600 and the protection layer 110, and the sealing member 700 is in a positional relationship that recedes toward the pressure chamber side than the surface on the ejecting side of the mask plate 600. In this embodiment, the ink repellent film 114 and the sealing member 700 serve as an isolation layer that prevents moisture from permeating into the protection layer 110.

In the inkjet head 131 according to the present embodiment, similarly to the inkjet head 31 according to the first embodiment, since the mask plate 600 covering the ejecting side of the sealing member 700 is provided at the connecting portion 102*c*, it is possible to suppress the height of the step portion of the disc surface 100*a*. Furthermore, in the inkjet head 131 according to the present embodiment, the edge portion of the mask plate 600 is covered with the ink repellent film 114, so that moisture penetration in the wiring portions of the first electrode 103 and the second electrode 104 can be prevented, and thus the insulation reliability between the electrodes can be enhanced. That is, even when the protection layer 110 is made of a highly hydrophilic nitride, an oxide, or the like and a material having low hydrophobicity is used, moisture in the air and moisture in the ejected liquid can be prevented from permeating into the protection layer 110 between the ink repellent film 114 and the electrode terminal portions 103*c* and 104*c*, and corrosion can be prevented.

It should be noted that the present invention is not limited to the examples described above, and can be implemented by appropriately changing the materials, shapes and manufacturing methods of the respective components. The material of the pressure chamber base 200, the separation plate 300, and the channel base 400 is not limited to a silicon wafer or stainless steel. The structure such as the pressure chamber base 200, the separation plate 300, and the channel base 400 may be made of other materials in consideration of the difference in the expansion coefficient of the driving substrate 100, in a range not affecting the ink ejecting pressure generated in the pressure chamber 201. For example, a nitride such as alumina, zirconia, silicon carbide, silicon nitride, barium titanate, or the like, or an oxide thereof may be used as the ceramic material. Further, as the resin material, a plastic material such as ABS (acrylonitrile butadiene styrene), polyacetal, polyamide, polycarbonate, polyether sulfone, polypropylene or the like may be used. Also, a metal material or alloy may be used, and a material such as aluminum, titanium or the like may be used as a typical material.

The material of the mask plate 600 is not limited to the example of the embodiments described above, and may be made of other materials such as ceramics, glass, quartz, resin, or metal. The mask plate 600 is not limited to the "L-shaped" plate having the top plate portion 601 and the side plate portion 602, and may have a shape to cover all of the periphery of the plate having the opening portion and the driving substrate 100.

Note that the throttle 301 is not necessary depending on design such as a diameter and a depth of the pressure chamber 201.

According to at least one embodiment described above, it is possible to provide an inkjet head and an inkjet apparatus which can suppress variations in the step height of the ejecting surface 100*a* by providing the mask plate 600 covering the seal member 700.

In the above embodiment, the liquid ejecting apparatus is used in an inkjet apparatus, but the present invention is not limited thereto. For example, it may be used for 3 d printers, industrial manufacturing machines, medical applications, and the like.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. These embodiments and variations thereof are included in the scope and spirit of the invention and are included within the scope of the appended claims and their equivalents.

What is claimed is:

1. A liquid ejecting head comprising:
- a driving substrate including:
  - a nozzle through which a liquid is to be discharged in a first direction,
  - a driving element configured to, in response to a signal from an external controller, expand or contract so that the liquid is discharged from a pressure chamber through the nozzle, and
  - a wiring line arranged below the driving element in the first direction and electrically connected to the driving element, the wiring line extending to a connection portion through which the driving element is electrically connected to a wiring substrate connectable to the external controller;
- a sealing member that covers a part of the wiring substrate, wherein an upper part of the sealing member is located farther from the wiring line than an upper surface of the driving substrate in the first direction; and
- a mask plate partially covering the sealing member, wherein the mask plate contacts the upper part of the sealing member from above in the first direction.

2. The liquid ejecting head according to the claim 1, wherein
- the driving element includes a piezoelectric film and an electrode which is laminated on the piezoelectric film and is electrically connected to the connection portion through the wiring line.

3. The liquid ejecting head according to claim 1, wherein the driving substrate further includes:
- a diaphragm above which the driving element is formed; and
- a protection layer covering the driving element.

4. The liquid ejecting head according to claim 1, wherein
- the driving element has a ring shape, and
- the nozzle is formed by a passage passing through the hole of the driving element and penetrating the driving substrate to the pressure chamber.

5. The liquid ejecting head according to the claim 4, wherein
- the driving substrate includes an ink repellent film covering the driving element.

6. The liquid ejecting head according to claim 5, wherein
- the ink repellent film extends from the nozzle to the sealing member.

7. The liquid ejecting head according to claim 1, wherein
- the mask plate comprises a first surface that contacts the upper part of the sealing member and a second surface that extends perpendicular to the first surface.

8. The liquid ejecting head according to claim 7, further comprising:
- a pressure chamber base arranged below the driving substrate and including the pressure chamber; and
- a channel base arranged below the pressure chamber base and including a common chamber communicating with the pressure chamber, wherein
- the second surface extends in a direction in which the driving substrate, the pressure chamber base, and the channel base are stacked.

9. The liquid ejecting head according to claim 7, wherein
- the mask plate has an L-shape.

10. The liquid ejecting head according to claim 7, wherein
- the second surface and a part of the wiring substrate extend in the same direction.

11. A liquid ejecting apparatus comprising:
- a controller;
- a liquid tank that stores liquid; and
- a liquid ejecting head connected to the liquid tank and comprising:
  - a driving substrate including:
    - a nozzle through which a liquid is to be discharged in a first direction,
    - a driving element configured to, in response to a signal from the controller, expand or contract so that the liquid is discharged from a pressure chamber through the nozzle, and
    - a wiring line arranged below the driving element in the first direction and electrically connected to the driving element, the wiring line extending to a connection portion through which the driving element is electrically connected to a wiring substrate connectable to the controller,
  - a sealing member that covers a part of the wiring substrate, wherein an upper part of the sealing member is located farther from the wiring line than an upper surface of the driving substrate in the first direction, and
  - a mask plate partially covering the sealing member, wherein the mask plate contacts the upper part of the sealing member from above in the first direction.

12. The liquid ejecting apparatus according to claim 11, wherein the driving element includes a piezoelectric film and an electrode which is laminated on the piezoelectric film and is electrically connected to the connection portion through the wiring line.

13. The liquid ejecting apparatus according to claim 11, wherein the driving substrate includes a diaphragm above which the driving element is formed, and a protection layer covering the driving element.

14. The liquid ejecting apparatus according to claim 11, wherein the driving element has a ring shape, and the nozzle is formed by a passage passing through the hole of the driving element and penetrating the driving substrate to the pressure chamber.

15. The liquid ejecting apparatus according to claim 14, wherein the driving substrate includes an ink repellent film covering the driving element.

16. The liquid ejecting apparatus according to claim 15, wherein the ink repellent film extends from the nozzle to the sealing member.

17. The liquid ejecting apparatus according to claim 11, wherein the mask plate comprises a first surface that contacts the upper part of the sealing member and a second surface that extends perpendicular to the first surface.

18. The liquid ejecting apparatus according to claim 17, further comprising:

a pressure chamber base arranged below the driving substrate and including the pressure chamber; and a channel base arranged below the pressure chamber base and including a common chamber communicating with the pressure chamber, wherein the second surface extends in a direction in which the driving substrate, the pressure chamber base, and the channel base are stacked.

19. The liquid ejecting apparatus according to claim 17, wherein the mask plate has an L-shape.

20. An image forming apparatus comprising:

a controller configured to output a signal according to an image to be formed;

an ink tank that stores ink; and an ink ejecting head connected to the ink tank and comprising:

a driving substrate including:

a nozzle through which the ink is to be discharged in a first direction, and a driving element configured to, in response to a signal from the controller, expand or contract so that the liquid is discharged from a pressure chamber through the nozzle, and a wiring line arranged below the driving element in the first direction and electrically connected to the driving element, the wiring line extending to a connection portion through which the driving element is electrically connected to a wiring substrate connectable to the controller, a sealing member that covers a part of the wiring substrate, wherein an upper part of the sealing member is located farther from the wiring line than an upper surface of the driving substrate in the first direction, and a mask plate partially covering the sealing member, wherein the mask plate contacts the upper part of the sealing member from above in the first direction.

* * * * *